US005083780A

United States Patent [19]

Walton et al.

[11] Patent Number: 5,083,780

[45] Date of Patent: Jan. 28, 1992

[54] GOLF CLUB SHAFT HAVING SELECTIVE REINFORCEMENT

[75] Inventors: Thomas C. Walton, Pepperell; Frank Fenton, South Hadley, both of Mass.

[73] Assignee: Spalding & Evenflo Companies, Inc., Tampa, Fla.

[21] Appl. No.: 471,750

[22] Filed: Jan. 29, 1990

Related U.S. Application Data

[63] Continuation-in-part of Ser. No. 330,347, Mar. 28, 1989.

[51] Int. Cl.[5] ..... A63B 53/10

[52] U.S. Cl. ..... 273/80 B; 273/DIG. 23

[58] Field of Search ..... 273/80 R, 80 B, 77 R, 273/77 A, DIG. 7, DIG. 23, 80.1-80.9; 428/364, 368, 377; 43/18.5

[56] References Cited

U.S. PATENT DOCUMENTS

| | | | |
|---|---|---|---|
| 1,535,667 | 4/1922 | Horne | 273/81 B |
| 1,917,795 | 7/1930 | Fetter | 273/80 R |
| 2,155,517 | 4/1939 | Turner | 273/80 |
| 2,573,361 | 10/1951 | Rodgers, Jr. et al. | 273/80 R X |
| 2,809,144 | 10/1957 | Grimes | 273/80 R X |
| 3,461,593 | 8/1967 | Martuch et al. | 43/18.5 |
| 3,614,101 | 10/1971 | Hunter | 273/80.2 |
| 3,646,610 | 2/1972 | Jackson | 273/80 R |
| 3,972,529 | 8/1976 | McNeil | 273/80 B |
| 3,998,458 | 12/1976 | Inoue et al. | 273/80 R |
| 4,023,801 | 5/1977 | VanAuken | 273/80 B |
| 4,082,277 | 4/1978 | Van Auken et al. | 273/80 R |
| 4,084,819 | 4/1978 | Van Auken | 273/80 R |
| 4,097,626 | 6/1978 | Tennent | 273/80 R X |
| 4,131,701 | 12/1978 | VanAuken | 273/80 R X |
| 4,135,035 | 1/1979 | Branen et al. | 428/377 |
| 4,157,181 | 6/1979 | Cecka | 273/80 R |
| 4,188,032 | 2/1980 | Yanagioka | 273/80 R |
| 4,280,700 | 7/1981 | Plagenhoef | 273/77 A |
| 4,319,750 | 3/1982 | Roy | 273/80 B |
| 4,555,113 | 11/1985 | Shimazaki et al. | 273/80 B |
| 4,580,785 | 4/1986 | Toku | 273/186 A |
| 4,648,598 | 3/1987 | Kim | 273/80 R |
| 4,725,060 | 2/1988 | Iwanaga | 273/77 A |
| 4,757,997 | 7/1988 | Roy | 273/80 R |
| 4,836,545 | 6/1989 | Pompa | 273/80 B |

FOREIGN PATENT DOCUMENTS

| | | | |
|---|---|---|---|
| 705035 | 3/1965 | Canada | 273/72 R |
| 2053004 | 2/1981 | United Kingdom | 273/80 B |
| 2053698 | 2/1981 | United Kingdom | 273/80 B |

*Primary Examiner*—Edward M. Coven
*Assistant Examiner*—Sebastiano Passaniti
*Attorney, Agent, or Firm*—Donald R. Bahr; John E. Benoit

[57] ABSTRACT

A golf shaft selectively reinforced with a composite outer shell substantially shorter in length than the golf shaft. A single shell is molded at a selected location over the shaft. The location of the shell controls the kick point of the golf shaft. The shell is comprised of a reinforced polymeric composite.

2 Claims, 3 Drawing Sheets

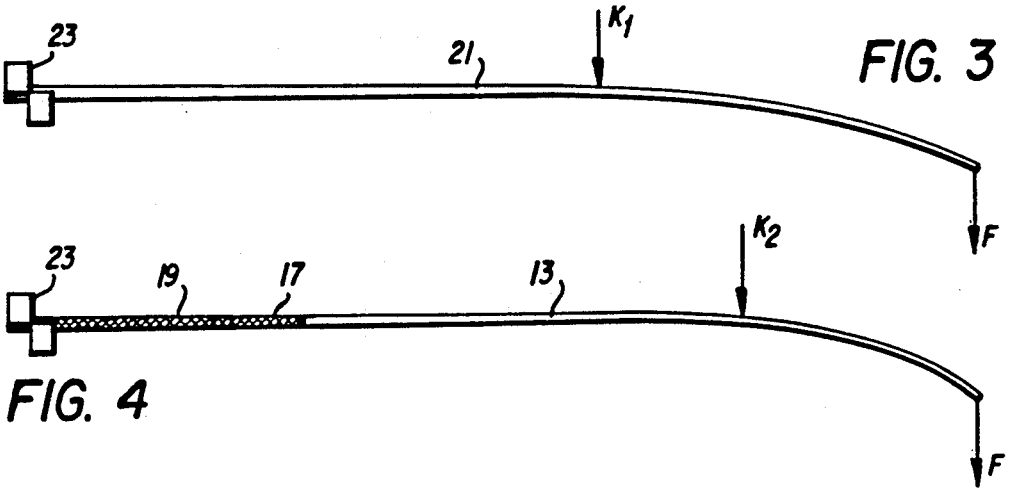
FIG. 3
FIG. 4
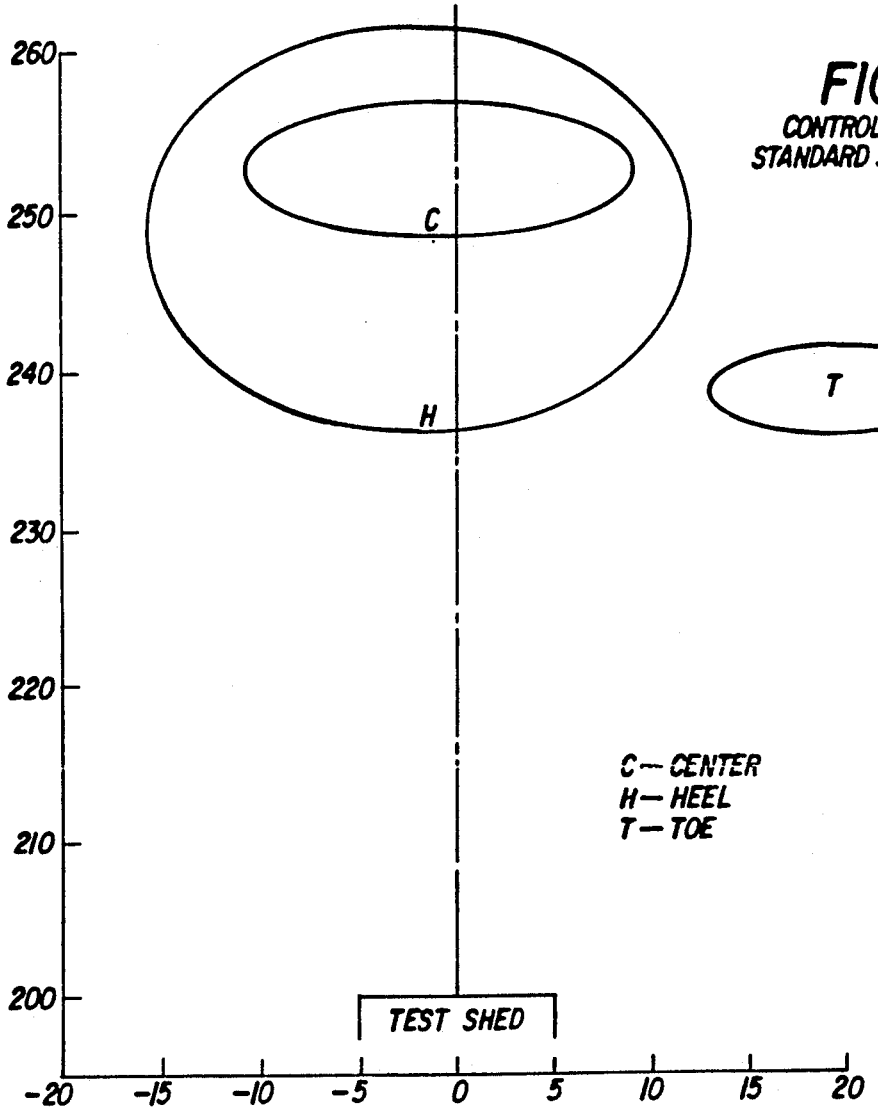
FIG. 10
CONTROL CLUB
STANDARD STEEL SHAFT

GOLF CLUB SHAFT HAVING SELECTIVE REINFORCEMENT

This application is a continuation-in-part of application Ser. No. 07/330,347 filed Mar. 28, 1989.

The present invention relates to golf club shafts and particularly to a golf club shaft having a reinforced polymeric composite shell selectively secured to said shaft so as to reinforce the shaft, vary the kick point of said shaft, and dampen vibration.

BACKGROUND OF THE INVENTION

In recent years, golf club shafts formed of fiber reinforced plastic have increasingly replaced metallic shafts in order to attain weight reduction. Such shafts are usually manufactured by rolling layers of oriented unidirectional prepreg (of carbon/graphite fibers) over a metallic mandrel. The lay-up is then compressed and heated to cure the epoxy matrix and form the shaft.

In most of the conventional fiber-reinforced plastic shafts, the fiber orientation angle, which is the angle formed by each layer of prepreg relative to the shaft axis, varies from layer to layer paired with changes in shaft outside diameter through the entire shaft length and addition of costly high modulus fibers into certain sections of the shaft, which provide a particular flex section or kick point on the shaft. It is found to be desirable to be able to adjust the kick point, or shaft flex point, for various clubs in order to provide the feel of the club which is desirable for the golfer.

Various means have been disclosed and used for changing the kick point of the club of these fiber-reinforced plastic shafts. One method of controlling the flex zone is disclosed in U.S. Pat. No. 4,319,750 issued Mar. 16, 1982. In this particular patent, various laminations fabricated from various layers of fiber materials embedded in a suitable synthetic resin material are used to adjust the kick point of the shaft, and organic reinforcing fibers and matrix serve to dampen vibration, thus, improving the feel of the shaft.

Another means of adjusting the kick point of the shaft is disclosed in U.S. Pat. No. 4,725,060 issued Feb. 16, 1988. This patent also relates to fiber-reinforced plastic shafts. In order to adjust the kick point of the shaft, an intermediate section is interposed between a head-side section and a grip-side section, with the filament-winding angle in the intermediate section being different from that in the head-side and grip-side sections so that a maximum bendability is provided at the flex section.

United Kingdom Patent Application 2,053,698A, published Feb. 11, 1981, discloses a golf club having a metal shaft, with the shaft being reinforced adjacent the hosel and/or the hand grip by a bonded sheath of carbon fiber-reinforced thermosetting plastic material which renders the shaft playable.

United Kingdom Patent Application 2,053,004, published Feb. 4, 1981, discloses a golf club shaft which has a portion intermediate the extremities of the shaft which is of increased mass per unit length. This controls the position of the dynamic "kick" or "flex" of the shaft.

U.S. Pat. No. 4,135,035, issued Jan. 16, 1975, discloses the use of aramid and carbon to form a lightweight, stiff golf club shaft.

Canadian Patent 705,035, issued Mar. 2, 1975, discloses a ball bat which is reduced in cross-section at the handle so as to provide a sleeve with a flush fit.

U.S. Pat. No. 4,280,700, issued July 28, 1981, discloses a golf club set where the grip is enlarged to enhance holding the club. The grip includes a weighted insert.

U.S. Pat. No. 3,614,101, issued Oct. 19, 1971, discloses a golf club shaft which uses a lightweight wrapping for the grip.

While the above patents provide the desired results, it is quite clear that such systems are available only in fiber-reinforced plastic and some specially designed metallic shafts. These shafts cannot be used without reinforcement due to lack of durability and weakness of the shaft. Even when reinforcing the shafts, the incorporation must be done during the manufacture of the shaft itself. When reinforcing a particular portion of a metallic shaft, the wall thickness and, therefore, the weight of the shaft are increased.

Accordingly, it would be desirable to be able to adjust the kick point and, thus, the feel of the shaft in a relatively easy-to-manufacture process using high strength/weight and high stiffness/weight ratio materials. The shaft of the present invention has good durability and stiffness even before the shaft is laminated with the novel composite combination shell described below. The use of 50% by volume aramid reinforcement is necessary as well as a strand angle between 30° and 45°. Further, no sandblasting is necessary since the braided reinforcement is bonded directly to the c steel shaft by the epoxy resin in the shell. Additionally, without the use of the aramid, the feel of the hit (with reference to vibration dampening) would be too severe using graphite bondings at an angle below 30°. The present invention provides such a means for selecting the kick point of a shaft and reinforcing a section of the shaft by use of the lighter, stiffer composite material.

SUMMARY OF THE INVENTION

The present invention uses either a metallic or a reinforced plastic shaft which is selectively reinforced with a reinforced polymeric composite shell. The shell is substantially shorter in length than the golf shaft and may be secured to the shaft at selected locations over the shaft. The location of the shell controls the kick point of the golf shaft. The shell is formed from a sleeve of prepreg material containing epoxy resin and fibers. When the sleeve is placed about a section of the shaft and heated under pressure, a shell of a reinforced composite braided structure is secured in place. In the present invention, the braided reinforcement preferably consists mixture of aramid such as Kevlar and carbon/graphite fibers. When the braided reinforcement sleeve is placed over the steel shaft and pressure and heat are applied, the epoxy resin from the preimpregnated braid adheres to the chromed shaft so as to form the finished shell and laminate it to the shaft. The resultant composite shell serves to dampen vibrations, thus improving the feel of the club. The composite shaft of the present invention has a cost advantage over an expensive, high-modulus, composite shaft with the same torsional value.

BRIEF DESCRIPTION OF THE DRAWINGS

FIG. 3 is a schematic view of a standard golf club under force F;

FIG. 4 is a schematic view of the golf club of FIG. 1 under force F;

FIG. 10 is a schematic view of a shot pattern spread for a standard steel club.

DETAILED DESCRIPTION OF THE PREFERRED EMBODIMENTS

Figure 1:
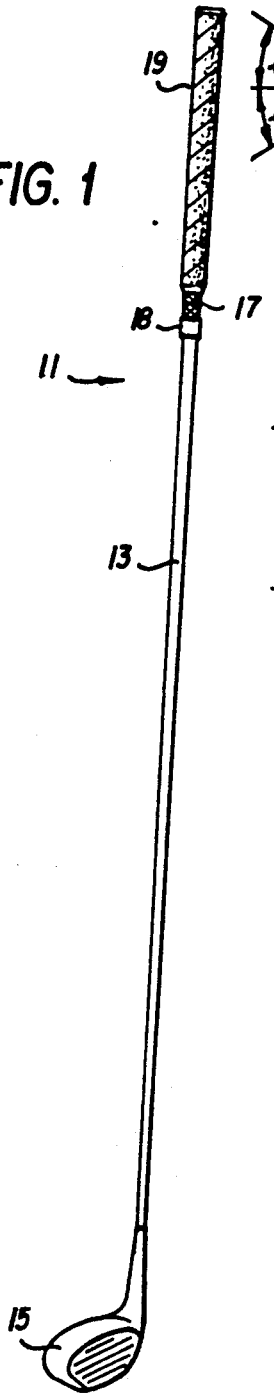
FIG. 1 is a schematic diagram of a golf club incorporating the present invention.

Referring to FIG. 1, there is shown golf club 11 having shaft 13 terminating at one end in club head 15 and at the other end in grip 19. In one embodiment of the invention there is shown braided composite shell 17 which, in the illustration, extends from the butt end and outwardly from the grip. Preferably, composite shell 17 extends a distance L of at least six inches from the butt end of the club. A ferrule 18 of a material such as cellulose acetate-butyrate is secured about the distal end of shell 17.

Figure 2:
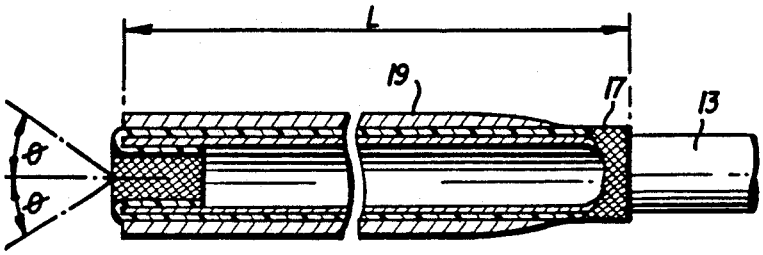
FIG. 2 is an enlarged partial sectional view of the golf club of FIG. 1.

FIG. 2 is a partial sectional view of the shaft of FIG. 1, showing the location of composite shell 17 about shaft 13 and inside of grip 19. As shown, shell 17 is formed about the end of the shaft and is laminated to the interior wall of the shaft. For purposes of clarity, the ferrule is not shown. As indicated, braided composite shell 17 is located, in this instance, at the butt end of the club.

The braided composite shell is comprised of reinforcement and resin matrix. The reinforcement can be any high-strength reinforcing fiber such as carbon/-graphite, aramid, fiberglass, ceramic, other organic or inorganic fibers, etc., or combinations thereof. The matrix can be a toughened polymeric matrix (e.g., thermoset matrices such as epoxy or vinyl ester, or thermoplastic matrices such as nylon 6, 6, ABS, etc.). Preferably, the composite shell in its final configuration about the shaft has a thickness between 0.015 inch and 0.020 inch.

After molding the composite shell to the shaft, a new flex, bounce point, or kick point is created to improve the feel by reducing vibration and playability of the shaft. This effect is obtained by increasing structural stiffness as well as reinforcing that particular area of the shaft where the composite shell is located.

For instance, a steel shaft reinforced on the butt end as shown in FIG. 1 would effectively improve the feel by reducing vibrations of the club. Further, it lowers the kick point, thus creating higher trajectories on the golfer's shots. This has long been known to be an area of needed improvement by golfers.

Even though the additional material increases the overall weight of the shaft, a weight savings can be achieved with the use of a lightweight grip to fit over the additional material, thus creating standard or lighter-weight shafts, depending on what type of metallic shaft is used. In fact, it is critical to marry the lightweight grip to the hybrid shaft to keep good feel and playability for the golfer and to keep the balance point of the shaft proper to yield normal "swing weights" of D1-D2 on the 14-inch fulcrum "Prorythmic" swing weight used by the majority of the golf industry. This marriage of the lightweight grip and hybrid shaft yields a lighter overall weight club at 12.25 ounces versus a standard weight club at 13.25 ounces.

The preimpregnated braid (prepreg) is laminated directly to the vapor-degreased metal without the use of special surface preparation or additional adhesives other than the prepreg matrix epoxy resin impregnated within the reinforcing braided sleeve.

Figure 6:
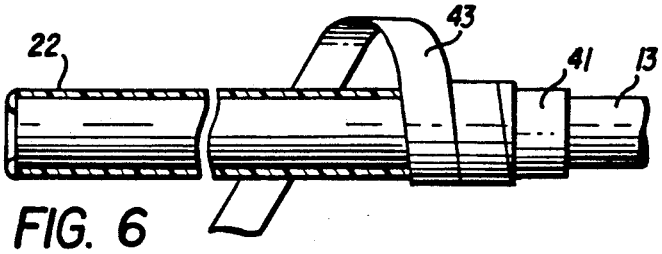
FIG. 6 is a partial sectional view showing the matrix being pressure-wrapped around the shaft.
Figure 7:
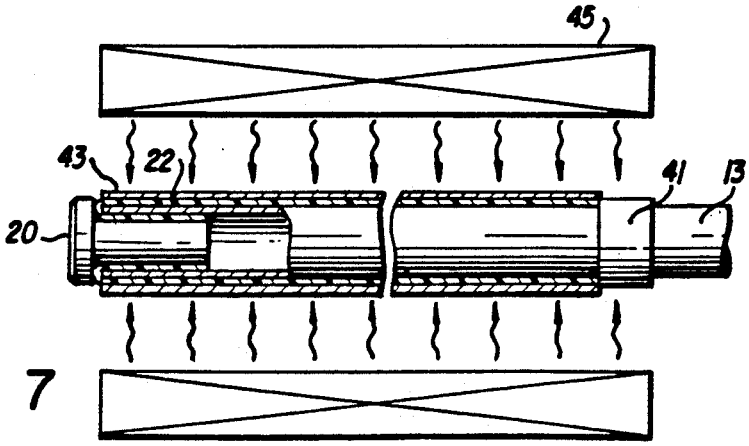
FIG. 7 is a partial sectional showing of the matrix being secured to the shaft.

The method of laminating the prepreg to the shaft is shown in FIGS. 6 and 7. Sleeve 22, which includes the epoxy resin, is placed over shaft 13 and extended into the interior of the butt end. Removable rubber plug 20 is secured within the butt end so as to press the distal end of sleeve 17 against the interior wall of the shaft. Polypropylene tape or nylon 6, 6 film 14 is wrapped about the shaft in several layers adjacent the shell to prevent the resin from flowing onto the exposed section of the shaft. Polypropylene tape or nylon 6, 6 film 43 is then spirally overlapped with tight tension over the prepreg so as to apply pressure thereto. This provides a pressure substantial enough to ensure a high quality laminate. As an example, a ⅝" wide film is wound so as to have three to four overlays per film width.

The shaft, wrapped as shown in FIG. 6, is passed through a 265° F. oven 45 for approximately two hours. The heat and pressure cause the resin in the prepreg to bond to the shaft so as to secure the prepreg reinforcement to the shaft. It is preferable to apply the heat with the shaft hung vertically in the oven. When finished, film 43 and plug 20 are removed. When a grip is placed over the butt end, the finished shaft of FIG. 2 results.

Referring to FIG. 3, there is shown schematically the effect of force F on standard golf shaft 21. The club is tested by placing the butt end in clamp 23. With a designated force F, kick point K1 occurs at a particular point on the shaft, as indicated.

FIG. 4 illustrates schematically the same test results using club 13 as modified in the manner shown in FIG. 2. In this case, composite shell 17 has been secured as shown in FIG. 1, extending to the butt end of the club. The force F, which is the same force exerted in the illustration of FIG. 3, shows that kick point K2 has been moved in the direction of the club head by the addition of composite shell 17.

Figure 5:
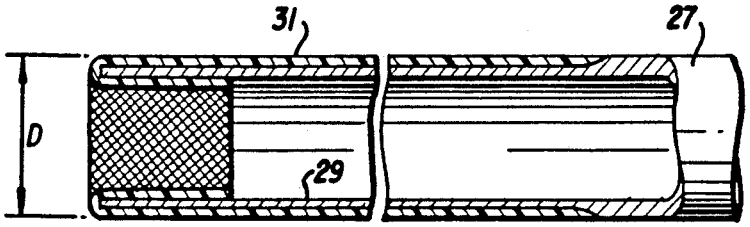
FIG. 5 is a sectional view of a modification of the club of FIG. 1.

FIG. 5 is a modification which reduces the weight of the club to compensate for the weight of the composite shell. In this case, diameter D of section 29 of shaft 27 has been reduced substantially a distance equivalent to the width of composite shell 31, which results in a diameter D of substantially 0.500 inch. This not only compensates for the weight, but also provides a smooth, continuous surface over the shaft itself.

Figure 8:
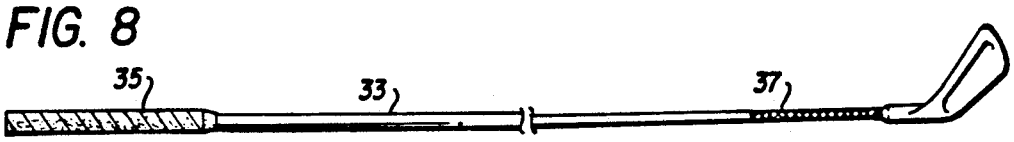
FIG. 8 is a schematic view of a modification of the club of FIG. 1.

FIG. 8 illustrates the placement of composite web 37 further down the shaft adjacent the club head. A test of the forces on such a shaft is shown schematically in FIG. 9, wherein the placement of web 37 as illustrated in FIG. 7 causes kick point K3 to move in a direction towards the butt end of the shaft.

As discussed above, the present invention provides a relatively economical and weight-saving method in which steel or other metallic shafts may be modified so as to adjust the kick point of the shaft. The reinforcing fibers, preferably at an angle between 30° and 45° from the axis of the shaft, and epoxy resin serve to dampen vibration, thus improving the feel of the golf club. For example, using a tailored shell composed of a toughened epoxy matrix stiffened with fifty per cent (50%) by volume aramid reinforcing fiber (e.g., Kevlar) and fifty per cent (50%) by volume carbon/graphite braided reinforcing strands provides both structural stiffness and vibration dampening since aramid fiber composites have an order of magnitude higher damping ratio than carbon/graphite reinforced composites. The strands are at an angle, FIG. 2 between 30° and 45° relative to the longitudinal axis of the shaft.

EXAMPLE

Tests conducted by a robotic golfer developed the following results:

Using golf heads of exactly the same loft, lie, face angle, roll and bulge, two identical length clubs were built to the same swing weight specification. The control club used was a standard steel-shafted club. The other club used was the shafted club of the present invention as shown in FIG. 1 with a shell having a composition as described above. The most notable difference in the clubs was the use of the shaft of the present invention for one club, which yielded a lighter overall weight of that club. This resulted from the use of a thinner grip and lighter weight steel shaft.

Using a mechanical golfer and the same standard launch conditions, machine power, and standard test golf balls, a test was conducted where a series of hits were conducted with the shafted club of the present invention and the standard steel control club. The hits were in a face scan sequence where a center hit is performed, then a toe hit, center hit again, then a heel hit, and so on, to create a series of impact points on the test field that show where the golf balls would land if hit on center or off center. The off center hits are important to simulate the tendencies of actual live golfers. The test produced the following results:

| | Distance (Yards) | Average Lateral Deviation from Center Line (Yards) |
|---|---|---|
| Control Club with Standard Steel Shaft | | |
| Center Hit | 252 | 1 Left |
| Toe Hit | 239 | 19 Right |
| Heel Hit | 249 | 2 Left |
| Shafted Club of the Present Invention | | |
| Center Hit | 254 | 1 Right |
| Toe Hit | 247 | 12 Right |
| Heel Hit | 251 | 0 |

If a shot pattern "spread" is created by looking at the average lateral deviation of the shots farthest to the left and the distance to average lateral deviations of the shots farthest to the right, it is seen that a "spread" for the control club is 21 yards while the spread for the shafted club of the present invention is only 12 yards.

Figure 9:
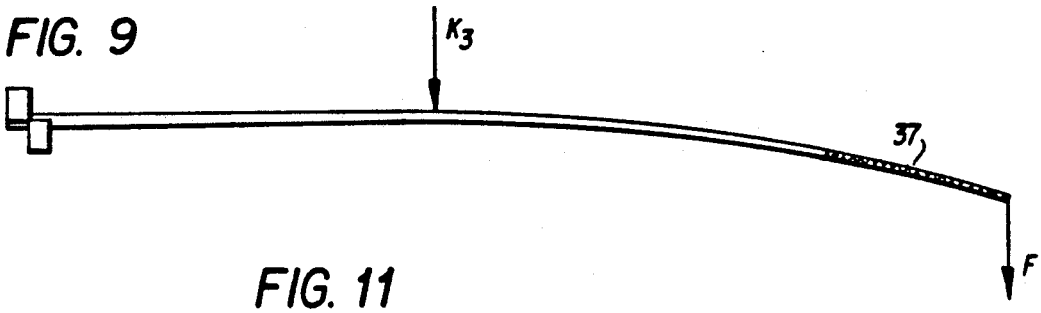
FIG. 9 is a schematic view of the club of FIG. 7 under force F.
Figure 11:
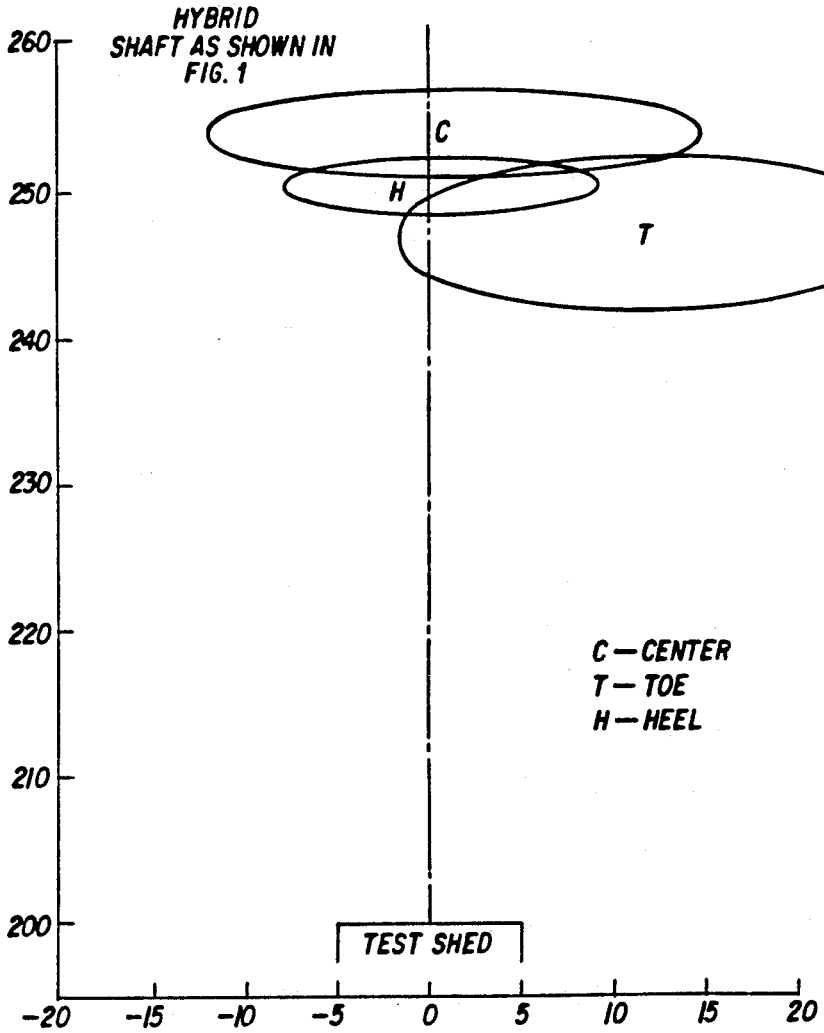
FIG. 11 is a schematic view of a shot pattern spread for a club as shown in FIG. 1.

Referring to FIGS. 9 and 10, there is shown computer generated elipses on the test field showing the landing locations from the data that was gathered.

As can be seen by the above information and the test field pictures of FIGS. 9 and 10, the shaft of the present invention was substantially more accurate, as well as longer in distance, most notably on the toe hits.

The benefits of the shaft of the present invention when the shell is placed at the butt end of the shaft are as follows:

(1) Stiffens the butt so as to remove unnecessary flex in the butt of the shaft, thus creating a slightly lower flex point for better feel and higher trajectory.

(2) Achieves the same low torque (e.g. 2–2.75 degrees per 1 ft.·lb. applied torque over full shaft length) as steel shafts for a much lower price than a high modulus graphite composite shaft.

(3) Allows the use of a softer flex (i.e., lighter) steel shaft that will create the desired stiffer flex after attaching the low density composite material.

(4) Using a standard butt size of 0.560 inch to 0.635 inch and then molding the composite shell thereon creates a larger outside diameter of shaft "butt" of 0.640 inch to 0.655 inch, thus allowing the use of a lighter, thinner grip to yield standard outside diameter grip sizes. This allows the steel shaft, composite material, and light weight grip to be equal to the weight of a high modulus, low torque, expensive graphite shaft and standard grip.

It should be noted that the non-reinforced shaft weight (prior to molding on the composite shell) should be greater than 90 grams to ensure a durable shaft base having a proper shaft flex desired by golfers. Anything less than this weight, such as shown in the above-referenced U.K. Patent Application 2,053,698A, would have durability problems and very weak flex characteristics.

While a standard grip could be used over the composite shell and still retain the benefits of the shell as discussed above, the reduction of weight by using a lighter grip is a definite advantage and, as stated earlier, critical to keeping the good feel and playability for the golfer.

The weight of the composite material is from 10 to 15 grams per foot and preferably 13 grams per foot. The length of the material will determine the final weight of the shell.

The weight of the grip is preferably from 20 grams to 39 grams. This is substantially lighter than the weight of the standard grip, which is approximately 52 grams.

EXAMPLE OF WEIGHTS

| | Weight in Grams |
|---|---|
| Shaft of the Present Invention | |
| Light Weight Steel Shaft | 97 |
| Composite Material | 13 |
| Light Weight Grip | 39 |
| | 149 |
| Expensive Graphite Shaft | |
| High Modulus Graphite Shaft | 98 |
| Standard Grip | 52 |
| | 150 |

The above description and drawings are illustrative, only, since modifications could be made without departing from the invention, the scope of which is to be limited only by the following claims.

We claim:

1. A shaft for a golf club comprising a tubular metal shaft having a butt end and a tip end and having a weight greater than 90 grams;

a polymeric shell having a reinforced composite braided structure, said shell being substantially shorter than said shaft and bonded to said shaft at a predetermined location, said shell comprising an epoxy polymeric matrix reinforced with a structure having aramid and carbon/graphite braided reinforcing stands, the angle of said strands relative to the longitudinal axis of said shaft being between 30° and 45°; and the outside diameter of the butt end of said metal shaft beneath said reinforced polymeric composite shell being reduced an amount substantially equivalent to the width of said composite shell so as to provide a smooth continuous shaft surface.

2. The shaft of claim 1 wherein the outside diameter of said butt end beneath said composite shell is substantially 0.560 inch.

* * * * *